United States Patent [19]

Sumitani

[11] Patent Number: 4,619,601

[45] Date of Patent: Oct. 28, 1986

[54] PULSE COMBUSTOR

[75] Inventor: Shigeto Sumitani, Fuji, Japan

[73] Assignee: Kabushiki Kaisha Toshiba, Kawasaki, Japan

[21] Appl. No.: 765,263

[22] Filed: Aug. 13, 1985

[30] Foreign Application Priority Data

Aug. 29, 1984 [JP] Japan ..... 59-179633

[51] Int. Cl.[4] ..... F23C 11/24

[52] U.S. Cl. ..... 431/1

[58] Field of Search ..... 431/1, 173

[56] References Cited

U.S. PATENT DOCUMENTS

| | | | |
|---|---|---|---|
| 1,956,664 | 5/1934 | Blake | 431/173 |
| 2,175,866 | 10/1939 | Arnold | 431/173 |
| 4,260,361 | 4/1981 | Huber | 431/1 |

FOREIGN PATENT DOCUMENTS

| | | |
|---|---|---|
| 574554 | 1/1946 | United Kingdom . |
| 576042 | 3/1946 | United Kingdom . |
| 1037287 | 7/1966 | United Kingdom . |
| 1081149 | 8/1967 | United Kingdom . |

*Primary Examiner*—Carroll B. Dority, Jr.

*Attorney, Agent, or Firm*—Cushman, Darby & Cushman

[57] ABSTRACT

A pulse combustor has a casing in which are defined a mixing chamber and a combustion chamber. The casing is formed with a first and second air inlet holes and a fuel inlet hole which open to the mixing chamber. An air supply pipe and a fuel supply pipe are connected to the first air inlet hole and the fuel inlet hole, respectively. The second air inlet hole communicates with the first air inlet hole through a communication hole formed in the casing. Air supplied through the air supply pipe is fed into the mixing chamber through the first and second air inlet holes.

5 Claims, 8 Drawing Figures

PULSE COMBUSTOR

BACKGROUND OF THE INVENTION

The present invention relates to a pulse combustor for pulsatively deflagrating a mixture gas of air and fuel in a combustion chamber.

Conventional hot-water supply systems are known which use a pulse combustor as a heating source. The pulse combustor generally comprises a combustion chamber and a cylindrical mixing chamber communicating with the upper-course side of the combustion chamber. The ends of an air supply pipe and a fuel supply pipe are connected to the mixing chamber. Air and fuel gas are fed into the mixing chamber through the air and fuel supply pipes, respectively. The fed air and fuel gas are mixed in the mixing chamber and deflagrated in the combustion chamber.

In general, in varying the combustion volume of a pulse combustor of this type, the inner diameter of the mixing chamber and the bore of the inlet port of the air supply pipe opening into the mixing chamber, need be changed. It is, therefore, impossible to obtain different combustion volumes with use of a single pulse combustor, so that the mixing chamber of the pulse combustor must be designed independently according to the desired combustion volume. Thus, the number of types of pulse combustors are increased, resulting in increased manufacturing cost. Inlet ports for air and fuel are generally formed in the peripheral wall of the mixture chamber, and located on the upper-course side thereof with respect to the flowing direction of the mixture gas in the mixing chamber. As a result, it is hard to mix the air and fuel properly in the mixing chamber. Even though the air supply is increased for a larger combustion volume, it is difficult for the mixture gas to experience complete combustion. Consequently, the combustion efficiency of the pulse combustor is low.

SUMMARY OF THE INVENTION

The present invention is contrived in consideration of these circumstances, and is intended to provide a pulse combustor capable of varying its combustion volume with relative ease without modifying the design of the mixing chamber, thereby permitting reduction in manufacturing cost, and of fully mixing air and fuel for higher combustion efficiency, despite an increase in the quantity of air supplied.

According to the present invention, there is provided a pulse combustor which comprises a casing having therein a cylindrical mixing chamber closed at one end, and a combustion chamber communicating with the open end of the mixing chamber, the casing including a first air inlet hole opening to the peripheral surface of the mixing chamber, a fuel inlet hole opening to the peripheral surface of the mixing chamber and substantially opposite to the first air inlet hole, and a second air inlet hole opening into the mixing chamber; an air supply pipe connected to the first air inlet hole for feeding air into the mixing chamber; and a fuel supply pipe connected to the fuel inlet hole for feeding fuel into the mixing chamber; and connecting means for connecting the second air inlet hole to the air supply pipe so that part of the air supplied through the air supply pipe is fed into the mixing chamber through the second air inlet hole.

BRIEF DESCRIPTION OF THE DRAWINGS

FIGS. 1 to 5 show a pulse combustor according to one embodiment of the present invention, in which FIG. 1 is a side view showing an outline of the pulse combustor, FIG. 2 is a sectional view showing a combustion chamber and a mixing chamber, FIG. 3 is a perspective sectional view of the mixing chamber, FIG. 4 is a view showing the relationship between the combustion volume of the pulse combustor and the residual oxygen content in exhaust gas, and FIG. 5 is a view showing the relationship between the combustion volume of the pulse combustor and the carbon monoxide content in exhaust gas;

DETAILED DESCRIPTION OF THE PREFERRED EMBODIMENTS

A pulse combustor according to one embodiment of the present invention will now be described in detail, with reference to the accompanying drawings of FIGS. 1 to 5.

Figure 1:
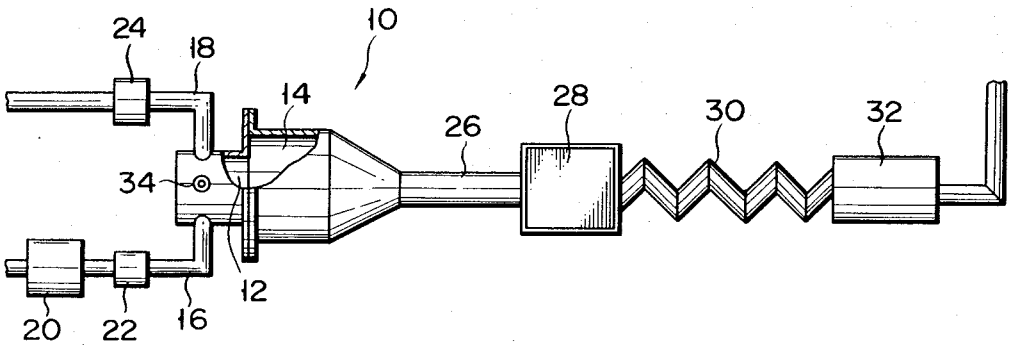

Referring first to FIG. 1, an outline of the pulse combustor will be described. As shown in FIG. 1, the pulse combustor is provided with a casing 10 in which are defined a bottomed cylindrical mixing chamber 12 and a combustion chamber 14 communicating with the open end of the mixing chamber 12. The casing 10 is connected with an air supply pipe 16 and a fuel supply pipe 18 which open into the mixing chamber 12. An intake muffler 20 and an air flapper valve 22 are disposed in the air supply pipe 16, and a fuel flapper valve 24 in the fuel supply pipe 18. Also, the casing 10 is connected, successively, with a tail pipe 26 communicating with the lower-course side of the combustion chamber 14, a decoupler 28, a heat exchanger 30, and an exhaust muffler 32. An ignition plug 34 for starting ignition is also provided on the casing 10 and projects into the mixing chamber 12.

Figure 2:
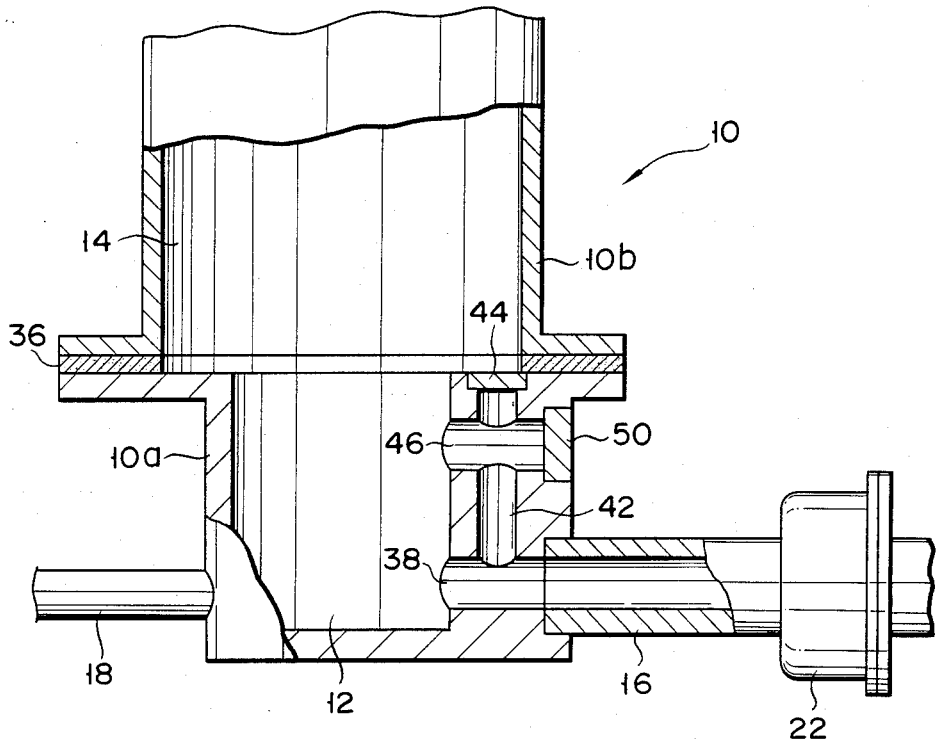
Figure 3:
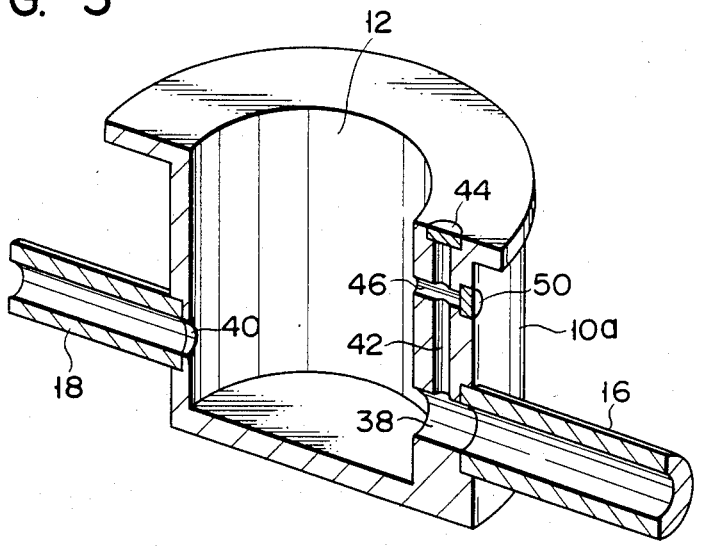

As shown in FIGS. 2 and 3, the casing 10 includes a bottomed cylindrical lower half portion **10*a* defining the mixing chamber 12 and a cylindrical upper half portion 10*b* defining the combustion chamber 14. The respective open ends of the two half portions 10*a* and 10*b* are coupled to each other through a seal member 36. The lower half portion 10*a* is formed with a first air inlet hole 38 and a fuel inlet hole 40 which open to the peripheral surface of the mixing chamber 12. The two inlet holes 38 and 40 are substantially opposite each other at the same height in the axial direction of the mixing chamber 12. One end of the air supply pipe 16 is coupled to the first air inlet hole 38, while that of the fuel supply pipe 18 is coupled to the fuel inlet hole 40**.

A communication hole 42 as connecting means is formed in the peripheral wall of the lower half portion **10*a*, and extends in the axial direction of the mixing chamber 12. One end of the communication hole 42 communicates with the first air inlet hole 38, while the other end opens to the open end of the lower half portion 10*a*. A blind plug 44 is fitted in the other end of the communication hole 42. A second air inlet hole 46 is bored through the peripheral wall of the lower half portion 10***a*, extending in the radial direction of the mixing chamber 12 and communicating with the communication hole 42. One end of the second air inlet hole 46 opens to the peripheral surface of the mixing chamber 12. The second air inlet hole 46 is located on the lower-course side of the first air inlet port 38 with respect to mixture gas flow, that is, on the side of the combustion chamber 14. The other end of the second air inlet hole 46 is closed by a blind plug 50. Thus, the second air inlet hole 46 communicates with the air supply pipe 16 by means of the communication hole 42 and the first air inlet hole 38.

The operation of the pulse combustor having the aforementioned construction will now be described.

At the start of the operation of the pulse combustor, a blower (not shown) is actuated so that air is fed from the air supply pipe 16 into the mixing chamber 12 through the intake muffler 20 and the air flapper valve 22, while fuel gas is fed from the fuel supply pipe 18 into the mixing chamber 12 through the fuel flapper valve 24. At this time, part of the air supplied through the air supply pipe 16 flows into the mixing chamber 12 through the first air inlet hole 38, while the remainder flows into the mixing chamber 12 through the communication hole 42 and the second air inlet hole 46. The air and fuel gas introduced into the mixing chamber 12 are mixed therein, and the resulting mixture gas is ignited by the ignition plug 34 and deflagrated in the combustion chamber 14. The deflagration of the mixture gas causes a pressure oscillation at a resonance frequency which is determined in accordance with the length between the combustion chamber 14 and the decoupler 28.

As the pressure inside the combustion chamber 14 increases, intake passages for air and fuel gas are closed by the air flapper valve 22 and the fuel flapper valve 24, respectively, thereby suddenly reducing the air and fuel gas supply. At the same time, combustion gas in the combustion chamber 14 suddenly expands toward the tail pipe 26 and is discharged externally via the tail pipe 26, decoupler 28, heat exchanger 30, and exhaust muffler 32. In a negative pressure region of the pressure oscillation, the air and fuel flapper valves 22 and 24 are opened, and thus, air and fuel gas are supplied into the mixing chamber 12 and deflagrated in the combustion chamber 14. Thereafter, the deflagration of the mixture gas is pulsatively repeated at regular cycles, following the aforesaid processes.

When the deflagration of the mixture gas is stabilized in about a few seconds after the start of the operation of the pulse combustor, the blower is stopped.

According to the pulse combustor constructed in this manner, the air supply pipe 16 communicates with the first and second air inlet holes 38 and 46. During pulse combustion, therefore, part of the air supplied through the air supply pipe 16 flows from the first air inlet hole 38 into the mixing chamber 12, while the remainder flows from the second air inlet hole 46, located on the lower-course side of the first air inlet hole 38, into the mixing chamber 12 through the communication hole 42. Accordingly, the air flowing into the mixing chamber 12 can be dispersed over a relatively wide range in the flow direction of the mixture gas in the mixing chamber 12. Thus, as compared with the case of the conventional system in which air is fed into the mixing chamber from only the first air inlet hole located on the upper-course side of the mixing chamber, air and fuel gas, according to this embodiment, can be mixed more satisfactorily in the mixing chamber 12. The improvement in the mixing condition for the air and fuel gas permits substantially complete combustion of the mixture gas, leading to improved combustion efficiency.

Figure 4:
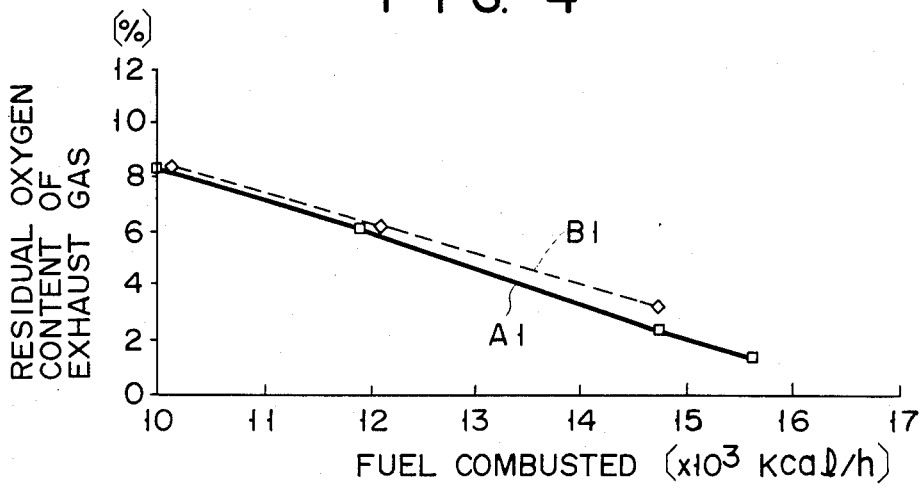
Figure 5:
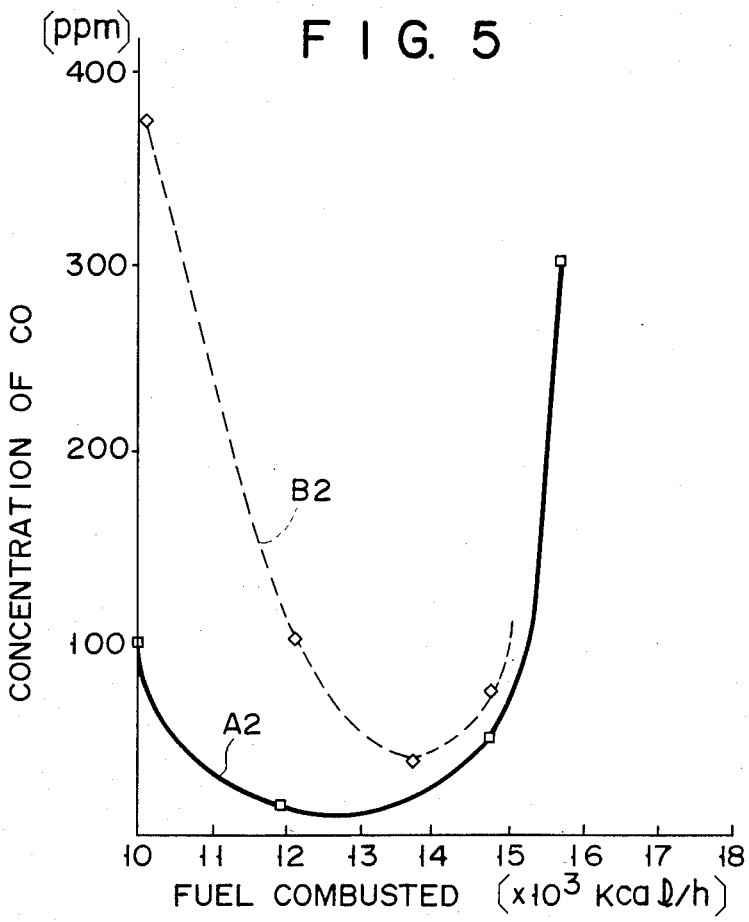

FIGS. 4 and 5 show the relationships between the combustion volume of the pulse combustor using methane (CH4) as the fuel gas, and the residual oxygen content in exhaust gas; and between the combustion volume and the carbon monoxide content in exhaust gas, thereby indicating the combustion efficiency of the pulse combustor. In FIGS. 4 and 5, full-characteristic lines A1 and A2 represent characteristics of the pulse combustor of this embodiment, while broken-characteristic lines B1 and B2 represent those of a prior art pulse combustor. As seen from these measurements, while the residual oxygen content in exhaust gas in the pulse combustor of this embodiment and the conventional one are substantially equal with each other, the pulse combustor of this embodiment is lower than the conventional one in the carbon monoxide content in exhaust gas, where the combustion volume is fixed. According to the pulse combustor of this embodiment, therefore, the combustion of the mixture gas can enjoy greater proximity to complete combustion for improved combustion efficiency even when the air supply is increased for a larger combustion volume.

According to the pulse combustor of this embodiment, moreover, the air supply to the mixing chamber 12 can be adjusted by properly setting the inner diameters of the air supply pipe 16, the communication hole 42, and the first and second air inlet holes 38 and 46. In varying the combustion volume of the pulse combustor, therefore, it is not always necessary to change the inner diameter of the combustion chamber. In other words, a single pulse combustor can provide different combustion volumes. Thus, the combustion volume can be changed with relative ease, and the number of types of pulse combustors can be reduced, resulting in lower manufacturing costs.

It is to be understood that the present invention is not limited to the embodiment described above, and that various changes and modifications may be effected therein by one skilled in the art, without departing from the scope of the invention.

Figure 6:
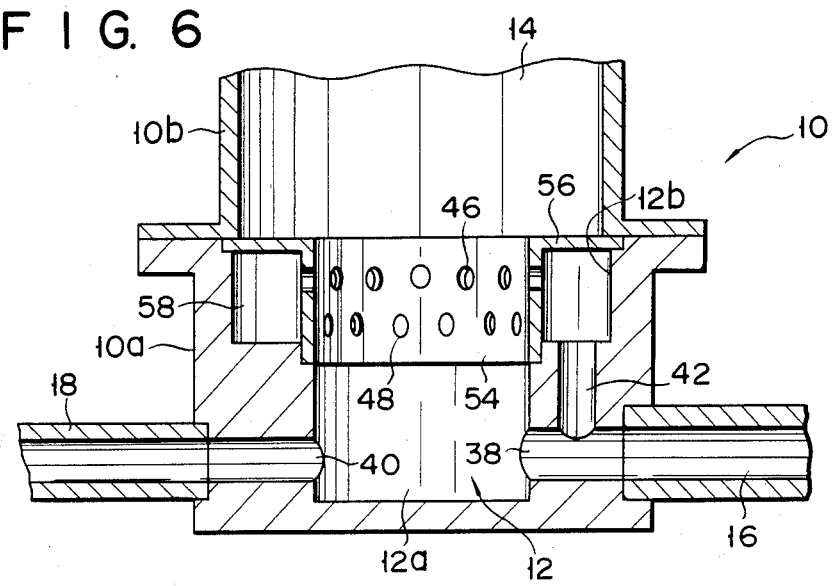
FIGS. 6 and 7 are a sectional view and an exploded perspective view, respectively, showing the principal parts of a pulse combustor according to another embodiment of the invention.
Figure 7:
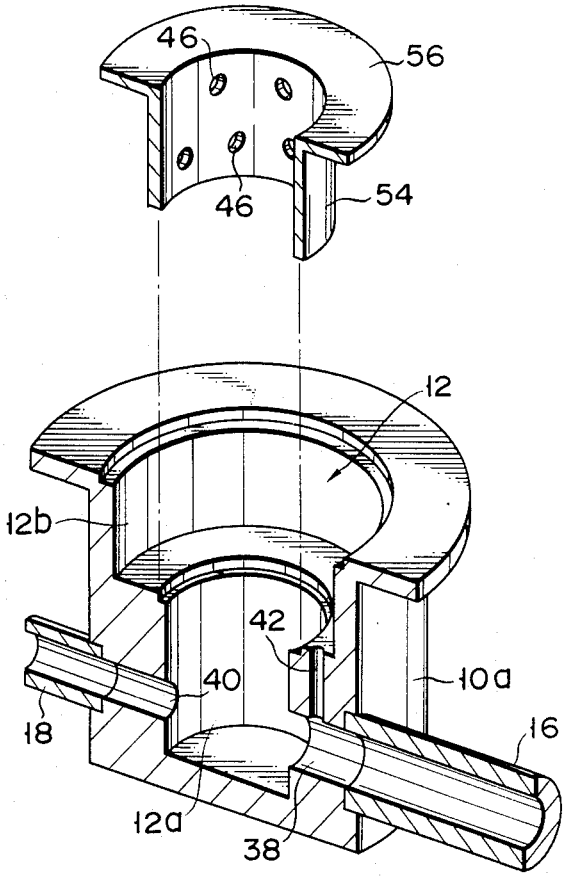

For example, the pulse combustor may be constructed as shown in FIGS. 6 and 7. In FIGS. 6 and 7, like reference numerals are used to designate like portions as included in the above embodiment. A description of those portions is omitted herein.

In this second embodiment, a lower half portion 10*a* of a casing 10 has the form of a bottomed cylinder with a thick peripheral wall, while a mixing chamber 12 is in the form of a stepped cylinder having a small-diameter portion 12*a* and a large-diameter portion 12*b* located closer to the combustion chamber 14. A first air inlet hole 38 and a fuel inlet hole 40 open to the peripheral surface of the small-diameter portion 12*a*. A communication hole 42 is formed in the peripheral wall of the lower half portion 10*a*, and extends in the axial direction of the mixing chamber 12. The lower end of the communication hole 42 communicates with the first air inlet hole 38, while the upper end opens to the shoulder portion of the lower half portion 10*a*, thus communicating with the large-diameter portion 12*b* of the mixing chamber 12. A thin-walled air charging cylinder 54 is disposed in the large-diameter portion 12*b*. The air charging cylinder 52 has a flange 56 on the outer periphery of its one end. A number of second air inlet holes 46 are bored through the peripheral wall of the air charging cylinder 52. The outer peripheral edge of the flange 56 of the air charging cylinder 52 is fitted in the end of the large-diameter portion 12*b* on the side of the combustion chamber 14 so that the other end of the air charging cylinder 52 is fitted in the end of the small-diameter portion 12*a* on the side of the large-diameter portion 12*b*. Thus, the inner surface of the large-diameter portion 12*b*, the outer peripheral surface of the air charging cylinder 54, and the flange 56, define an annular air passage 58 communicating with the communication hole 42 and the second air inlet holes 46.

In this embodiment, part of the air supplied through the air supply pipe 16 flows, during pulse combustion, from the first air inlet hole 38 into the mixing chamber 12, while the remainder flows into the air passage 58 through the communication hole 42. The air introduced into the air passage 58 flows from the second air inlet holes 46 into the mixing chamber 12.

According to the pulse combustor constructed in this manner, the air flowing into the mixing chamber 12 from the second air inlet holes 46 located on the lower-course side of the first air inlet port 38, is dispersed fairly uniformly in the circumferential direction of the mixing chamber 12. Thus, the air and fuel gas can be mixed more effectively in the mixing chamber 12.

Figure 8:
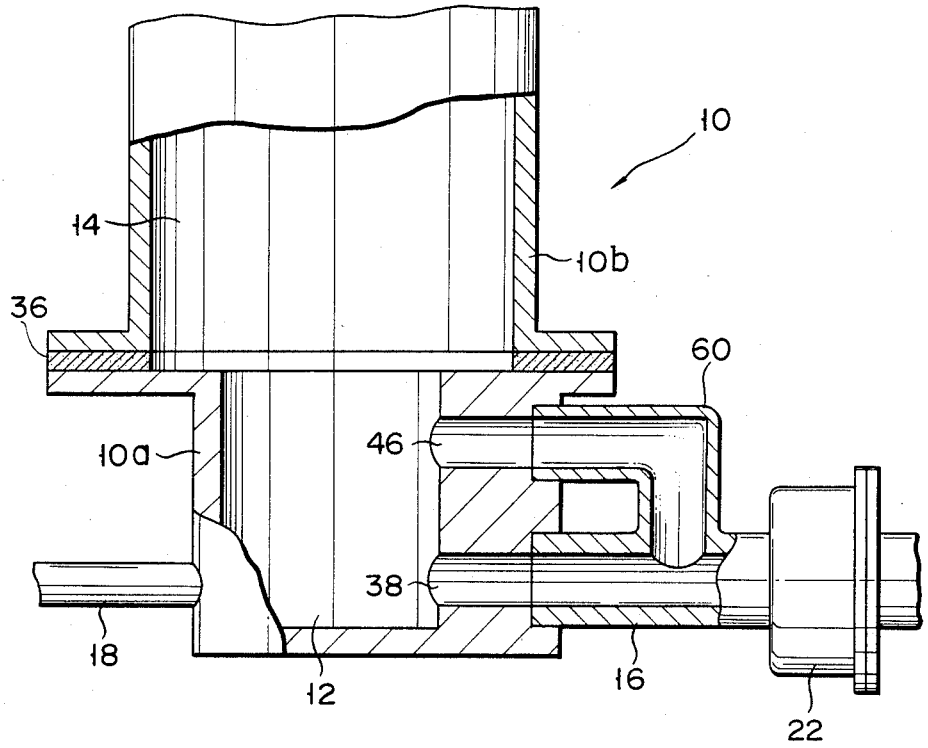
FIG. 8 is a sectional view showing the principal parts of a pulse combustor according to still another embodiment of the invention.

In the first and second embodiments described above, the second air inlet hole or holes communicate with the air supply pipe by means of the communication hole formed in the casing. As shown in FIG. 8, however, a second air inlet hole 46 may be bored through the peripheral wall of the lower half portion 10*a* of the casing 10 so that a branch pipe 60, diverging from the air supply pipe 16, is connected to the second air inlet port 46.

What is claimed is:

1. A pulse combustor comprising:

a casing having therein a cylindrical mixing chamber closed at one end, and a combustion chamber communicating with the open end of the mixing chamber, said casing including a first air inlet hole opening to the peripheral surface of the mixing chamber, a fuel inlet hole opening to the peripheral surface of the mixing chamber and substantially opposite to the first air inlet hole, and a second air inlet hole opening into the mixing chamber downstream of said first air inlet hole toward said combustion chamber;

an air supply pipe connected to a source of air and connected to the first air inlet port for feeding air into the mixing chamber;

a pipe connected to a source of fuel and connected to the fuel inlet port for feeding fuel into the mixing chamber;

connecting means for connecting the second air inlet hole to the air supply pipe so that part of the air supplied through the air supply pipe is fed into the mixing chamber through the second air inlet hole; and means for producing pulse combustion in said combustion chamber.

2. The pulse combustor according to claim 1, wherein said connecting means includes a communication hole formed in the casing and opening into the first air inlet hole at one end and into the second air inlet hole at the other end.

3. The pulse combustor according to claim 1, wherein said connecting means includes a branch pipe diverging from the air supply pipe and connected to the second air inlet hole.

4. The pulse combustor according to claim 1, wherein said casing has an annular air passage formed outside the mixing chamber to be coaxial therewith, said connecting means having a communication hole formed in the casing and opening into the first air inlet port at one end and into the annular air passage at the other end, and said second air inlet hole including a number of air holes communicating with the air passage.

5. The pulse combustor according to claim 4, wherein said mixing chamber is in the form of a stepped cylinder including a small-diameter portion and a large-diameter portion on the combustion chamber side, said first air inlet hole and said fuel inlet hole opening to the peripheral surface of the small-diameter portion, said casing including an air charging cylinder disposed in the large-diameter portion, said air passage being defined by the outer peripheral surface of the air charging cylinder and the inner surface of the large-diameter portion, and said second air inlet hole being formed of a number of air holes bored through the peripheral wall of the air charging cylinder.

* * * * *